US006068149A

United States Patent [19]

Telega

[11] Patent Number: 6,068,149

[45] Date of Patent: May 30, 2000

[54] CALENDARING CAP FOR A PHARMACEUTICAL CONTAINER

[76] Inventor: Janice S. Telega, 2740 Coral Way, Macon, Ga. 31211

[21] Appl. No.: 08/944,726

[22] Filed: Oct. 6, 1997

[51] Int. Cl.[7] ..... B65D 41/04; B65D 41/10

[52] U.S. Cl. ..... 215/230; 116/308; 116/309; 206/534

[58] Field of Search ..... 206/534, 459.1, 206/459.5; 116/308, 309, 316, 317, 321, 323; 215/230

[56] References Cited

U.S. PATENT DOCUMENTS

| | | | |
|---|---|---|---|
| 2,111,637 | 3/1938 | Mehaffey | 116/308 |
| 2,215,466 | 9/1940 | Ehrlich | 116/316 X |
| 2,434,611 | 1/1948 | Hamiel | 116/308 X |
| 2,450,949 | 10/1948 | Gattuccio et al. | 116/308 |
| 2,706,464 | 4/1955 | North . | |
| 3,407,954 | 10/1968 | Millis | 215/43 X |
| 3,424,336 | 1/1969 | Perez et al. | 220/521 X |
| 3,460,508 | 8/1969 | Baxter | 116/317 |
| 3,522,666 | 8/1970 | Sarthou | 116/323 X |
| 3,684,117 | 8/1972 | Leopoldi et al. . | |
| 3,766,882 | 10/1973 | Babbitt, III . | |
| 4,041,628 | 8/1977 | Sasson | 40/111 |
| 4,920,912 | 5/1990 | Kirkling | 206/534 |
| 5,011,032 | 4/1991 | Rollman . | |
| 5,242,067 | 9/1993 | Garby et al. | 215/230 |
| 5,482,163 | 1/1996 | Hoffman . | |

*Primary Examiner*—Allan N. Shoap
*Assistant Examiner*—Joe Merek
*Attorney, Agent, or Firm*—Paul S. Rooy

[57] ABSTRACT

A calendaring cap for a pharmaceutical container comprising at least one ring frictionally and rotatably engaged with a cap. The cap comprises a cap bore having either a cap female thread or a cap bore lip, whereby the calendaring cap for a pharmaceutical container may be installed on a standard pharmaceutical container. Each ring bears a pointer which points towards indicia on the cap. In a calendaring cap for a pharmaceutical container embodiment incorporating two rings, the cap may bear day indicia and hour indicia. A first ring is associated with the day indicia, and its pointer points towards the day indicia. A second ring is associated with the hour indicia, and its pointer points towards the hour indicia. Thus a patient may use the day and hour indicia in conjunction with the pointers to specify when the last dose of medicine within a pharmaceutical container upon which the calendaring cap for a pharmaceutical container is installed was taken, or, in the alternative, when the next dose is due to be taken.

8 Claims, 3 Drawing Sheets

FIG 2
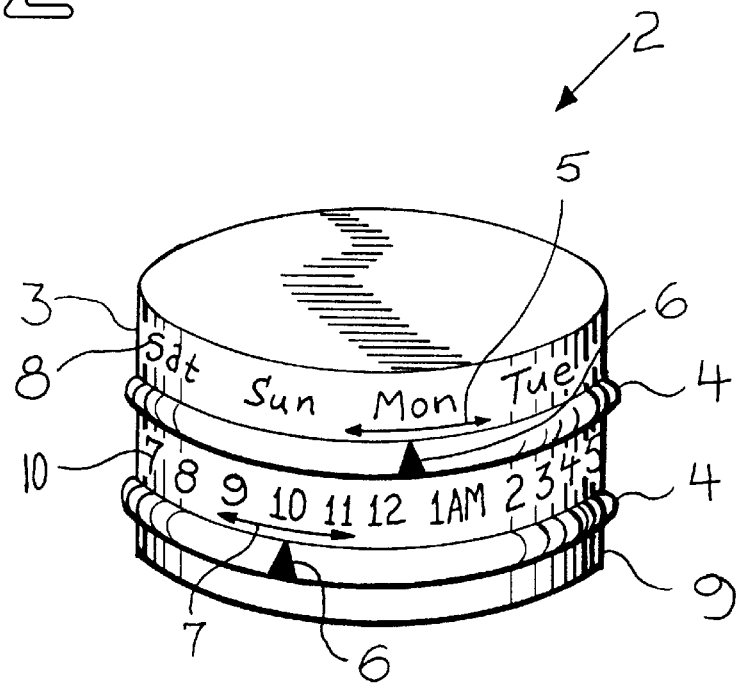
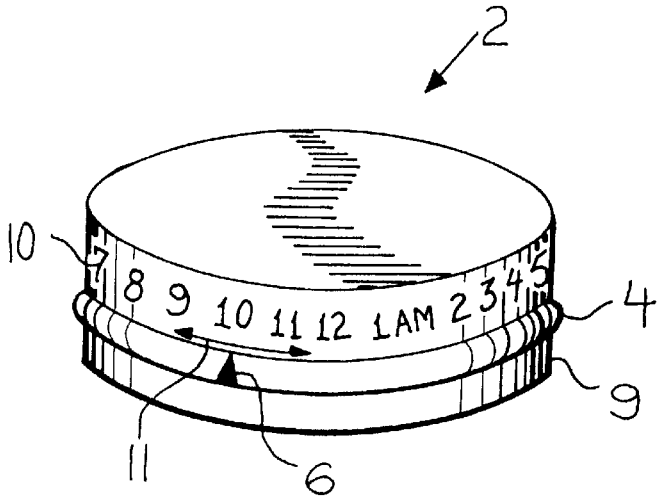
FIG 3

FIG 4
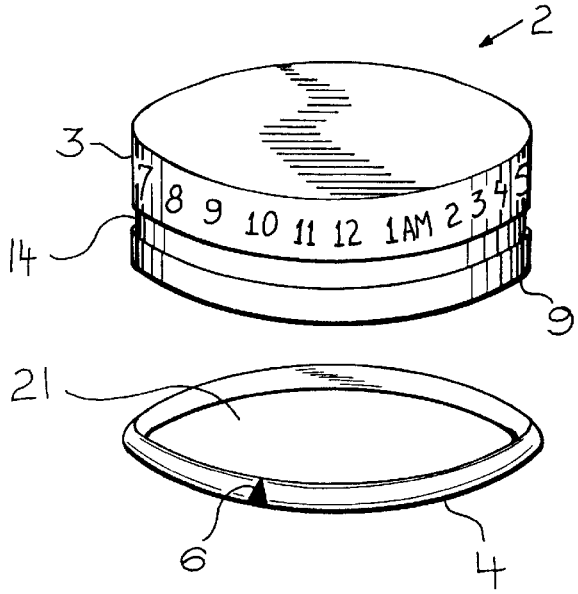
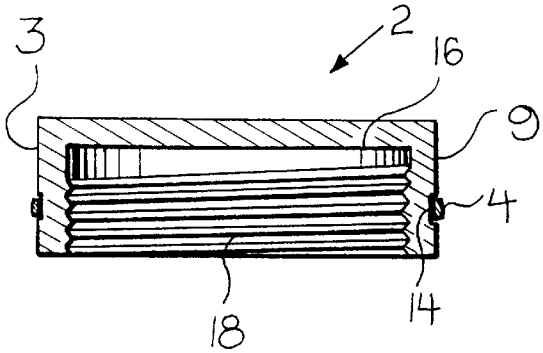
FIG 5
FIG 6
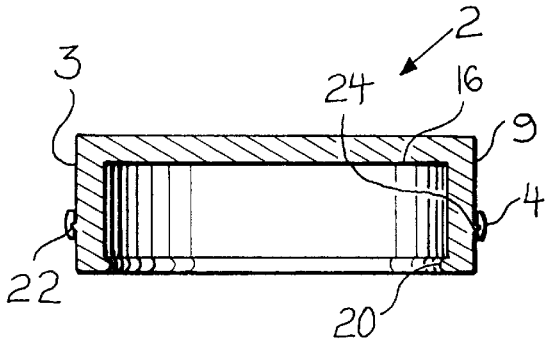

CALENDARING CAP FOR A PHARMACEUTICAL CONTAINER

BACKGROUND OF THE INVENTION

1. Field of the Invention

This invention relates to pharmaceutical container closures, and in particular to a calendaring cap for a pharmaceutical container.

2. Background of the Invention

Advances in medicine have made possible the accurate prescription of ethical pharmaceutical drugs to treat a wide variety of afflictions. Typically these pharmaceutical drugs must be ingested orally a number of times daily, every day of the week. It is not unusual for one individual to be taking several different drugs at one time.

Most of these drugs are self-administered—that is, the patient is responsible to for keeping track of what has been ingested, and when to ingest the next dose, of each drug. A major problem associated with this self-medication is the danger that the wrong dosage will be administered. This generally occurs where a patient forgets whether, and when, the previous dose was administered, and either duplicates a dose or skips a dose. Over time, such drug mis-administration detracts from the efficacy of the drug, and can even be life-threatening where the drug is dangerous in overdose, or where minimum doses are required for health reasons.

This problem becomes even worse where a patient's mental faculties have become impaired due to advanced years, the dulling effect of the selfsame drugs prescribed, or disease. Where the patient's memory is not very good, it is easy for the patient to forget whether the previous dose was administered, and thus the chances of mis-administration increase.

Where the patient is self-administering a number of different drugs (four or five different drugs is not uncommon) the problem may become especially severe—the patient may recall having self-administered one drug, when in fact a different drug was taken. This patient misperception can lead to overdose of some drugs, and underdosage of others. Thus the challenge becomes one of keeping track of when the last dose of a specific medication was self-administered.

Existing Designs

A number of designs have been suggested to remind the patient when the last dose of a given drug was self-administered. U.S. Pat. No. 5,482,163 was granted Hoffman for a Last Event Indicator, which featured a rotating ring around a pill bottle. The patient rotated the ring to indicate what day of the week and dose number was last self-administered. There were a number of problems associated with this design. First, the patent taught an entire bottle had to be manufactured with a rotating ring around it. This idea was relatively expensive because the entire bottle had to be changed from a standard pill bottle. In addition, only one ring was taught, which made it difficult to precisely specify which dose was last taken where several doses per day were required.

Several inventions featuring indicating means built into a bottle cap have been patented. Rollman and Leopoldi et al. were granted U.S. Pat. Nos. 5,011,032 and 3,684,117 respectively for rotating bottle caps which incorporated windows through which underlying indicia could be observed. These designs both required that an aperture (window) be formed through the cap which would provide an optical pathway through the cap. The Leopoldi et al. '117 patent was in fact for a type of combination lock-cap, not for a calendaring cap.

Mehaffey was granted U.S. Pat. No. 2,111,637 for a Bottle Cap With Indicating Means. This patent taught a ring rotating on a cap, which was attached to the cap by means of a washer and screw. This design suffered from the drawbacks of complexity and thus expense. In addition, the danger existed that the screw might unscrew itself over time, and the ring fall off, thereby erasing the record of the day and time when the previous dose was taken.

Several patents have been granted for caps which rotated relative to containers on which they were installed. North and Babbitt, III were granted U.S. Pat. Nos. 2,706,464 and 3,766,882 respectively for dose time indicating containers. Both provided a cap which rotated relative to a container upon which the cap was installed. One provided an pointer on the cap and time indicia inscribed on the container; the other provided an pointer on the container and time indicia inscribed on the cap. Both these designs relied on a frictional fit between the cap and the container for the designs to work.

There were a number of drawbacks associated with these designs. First, modem drug bottles incorporate childproof rotating caps, and these designs are incompatible with such childproof caps. Second, many modem pill bottles incorporate screw-on caps. The North and Bobbitt, III designs would not work with screw-on caps, because the rotational orientation of a screw cap relative to a container is determined by the length of the thread. Finally, because the North and Bobbitt, III caps are removed and replaced with every dose of medicine taken, the frictional fit between the cap and bottle might become loose over time. If the cap/bottle fit were to become too loose, the cap would not remain in the same rotational position relative to the bottle, thus rendering its indication unreliable.

SUMMARY OF THE INVENTION

Accordingly, it is an object of the present invention to provide a calendaring cap for a pharmaceutical container which is capable of specifying the day that the previous dose of medicine was administered or in the alternative, the day that the next dose of medicine is due to be administered. Design features allowing this object to be accomplished include a ring bearing a pointer in frictional engagement with a cap, and day indicia on the cap. Advantages associated with the accomplishment of this object include the prevention of under-dosing and over-dosing, along with the reduction of associated health hazards.

It is another object of the present invention to provide a calendaring cap for a pharmaceutical container which is capable of specifying the time that the previous dose of medicine was administered, or in the alternative, the time that the next dose of medicine is due to be administered. Design features allowing this object to be accomplished include a ring bearing a pointer in frictional engagement with a cap, and hour indicia on the cap. Advantages associated with the accomplishment of this object include the prevention of under-dosing and over-dosing, along with the reduction of associated health hazards.

It is still another object of this invention to provide a calendaring cap for a pharmaceutical container which is inexpensive to manufacture. Design features enabling the accomplishment of this object include a ring in frictional engagement with a cap, indicia on the cap, and a pointer on the ring. The cap is sized to mate with a standard pharmaceutical drug container. Two embodiments of the instant invention which permit it to mate with existing pharmaceutical drug containers include a cap female thread in a cap bore, or in the alternative, a cap bore lip on a cap bore. Advantages associated with the realization of this object include decreased cost, and thus increased availability to the consumer.

BRIEF DESCRIPTION OF THE DRAWINGS

The invention, together with the other objects, features, aspects and advantages thereof will be more clearly understood from the following in conjunction with the accompanying drawings.

Three sheets of drawings are provided. Sheet one contains FIG. 1. Sheet two contains FIGS. 2 and 3. Sheet three contains FIGS. 4, 5 and 6.

FIG. 2 is a front isometric view of a calendaring cap for a pharmaceutical container having two rings.

FIG. 3 is a front isometric view of a calendaring cap for a pharmaceutical container having one ring.

FIG. 4 is an exploded front isometric view of a calendaring cap for a pharmaceutical container.

FIG. 5 is a front cross-sectional view of a calendaring cap for a pharmaceutical container incorporating a cap female thread.

FIG. 6 is a front cross-sectional view of a calendaring cap for a pharmaceutical container incorporating a cap bore lip, and a cap ridge engaged with a ring bore groove.

DETAILED DESCRIPTION OF THE PREFERRED EMBODIMENT

Figure 1:
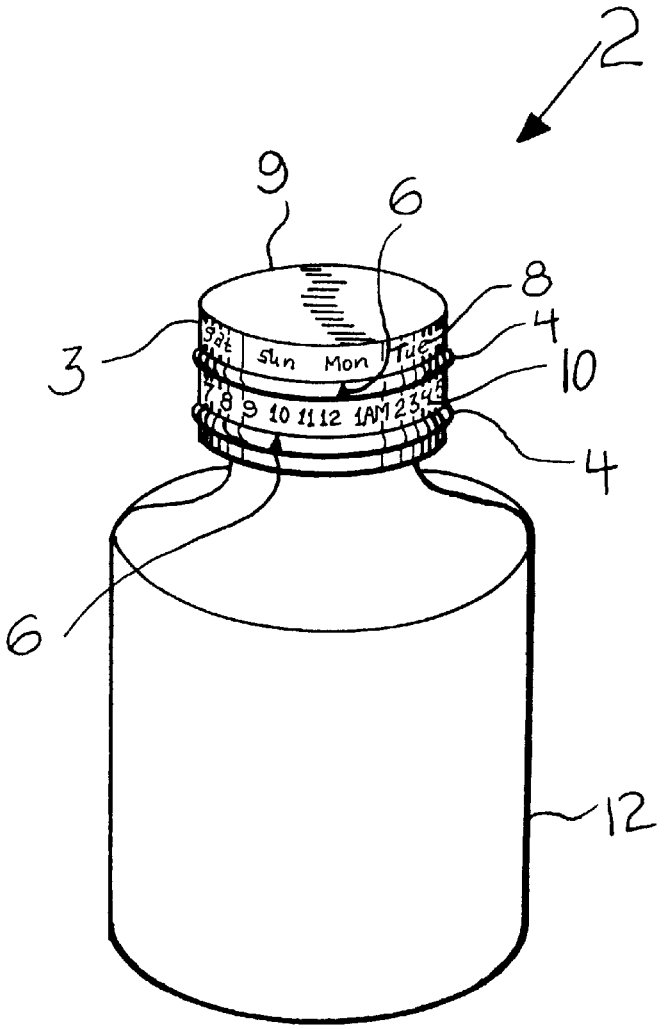
FIG. 1 is a front isometric view of a calendaring cap for a pharmaceutical container installed on a pharmaceutical container.

FIG. 1 is a front isometric view of calendaring cap for a pharmaceutical container 2 installed on a bottle 12. FIG. 2 is a front isometric view of calendaring cap for a pharmaceutical container 2 with two rings 4.

As may be observed in FIGS. 1 and 2, calendaring cap for a pharmaceutical container 2 comprises at least one ring 4 in frictional, rotatable engagement with cap 9. Cap 9 comprises cap outer surface 3, upon which day indicia 8 and hour indicia 10 are inscribed. A pointer 6 is inscribed on each ring 4. A first ring 4 is associated with day indicia 8, and its pointer 6 specifies a given day contained within day indicia 8. A second ring 4 is associated with hour indicia 10, and its pointer 6 specifies a given hour contained within hour indicia 10.

As may be observed in FIG. 2, the first ring 4, which is associated with day indicia 8, is in frictional, rotatable engagement with cap 9, and may be rotated relative to cap 9 as indicated by arrow 5. The frictional nature of the fit between ring 4 and cap 9 ensures that ring 4 (and its pointer 6) will remain in a constant rotational orientation relative to cap 9 (and day indicia 8).

Second ring 4, which is associated with hour indicia 10, is in frictional, rotatable engagement with cap 9, and may be rotated relative to cap 9 as indicated by arrow 7. The frictional nature of the fit between ring 4 and cap 9 ensures that ring 4 (and its pointer 6) will remain in a constant rotational orientation relative to cap 9 (and hour indicia 8).

FIG. 3 is a front isometric view of an alternate embodiment of calendaring cap for a pharmaceutical container 2 having a single ring 4. Where a medication administration schedule does not vary from day to day, only a single ring 4 is required, and only hour indicia 10 is required. This single-ring alternate embodiment may be manufactured less expensively than an embodiment incorporating multiple rings, thus increasing its affordability and availability to the consumer. In this alternate embodiment of calendaring cap for a pharmaceutical container 2, ring 4, which is associated with hour indicia 8, is in frictional, rotatable engagement with cap 9, and may be rotated relative to cap 9 as indicated by arrow 11. The frictional nature of the fit between ring 4 and cap 9 ensures that ring 4 (and its pointer 6) will remain in a constant rotational orientation relative to cap 9 (and hour indicia 8).

FIG. 4 is an exploded front isometric view of calendaring cap for a pharmaceutical container 2. FIGS. 4 and 5 depict cap groove 14 cut into cap outer surface 3. Ring 4 comprises ring bore 21, which is sized to frictionally fit within cap groove 14. Cap groove 14 constrains ring 4 from translating axially relative to cap 9, and thus prevents ring 4 from falling off cap 9. In addition, cap groove 14 constrains ring 14 in close proximity to the cap indicia with which it is associated, and pointer 6 points towards the indicia associated with the ring 4 on which pointer 6 is inscribed.

FIG. 5 is a front cross-sectional view of calendaring cap for a pharmaceutical container 2 incorporating cap female thread 18 on cap bore 16. Cap female thread 18 is sized to mate with a standard pharmaceutical container thread, and thus cap 9 may be of the child-proof variety. Ring 4 is frictionally engaged with cap groove 14.

FIG. 6 is a front cross-sectional view of calendaring cap for a pharmaceutical container 2 incorporating cap bore lip 20 in cap bore 16, and cap ridge 24 on cap outer surface 3 engaged with ring bore groove 22 in ring bore 21. Cap ridge 24 is sized to frictionally engage ring bore groove 22, such that ring 4 is in frictional engagement with cap 9. Cap bore lip 20 is sized to frictionally engage an opening of a standard pharmaceutical container. Thus FIG. 6 illustrates how the instant invention may be incorporated into a standard, "snap-on" pharmaceutical container cap.

In the preferred embodiment, cap 9 and rings 4 were made of plastic, other synthetic, or other appropriate material. Day indicia 8, hour indicia 10 and pointer 6 were stamped indelible ink marks, or may also be engravings or recessed stampings, or other appropriate marks.

In production, it is envisioned that ring 4 will be manufactured of a resilient material that may expand slightly during installation so that ring 4 may be slid over cap outer surface 3 until ring 4 frictionally nests within cap groove 14, or, in a different embodiment, until cap ridge 24 frictionally nests in ring bore groove 22.

In use, every time medication within bottle 12 is administered, the patient sets pointer(s) 6 to indicate the day and hour of medication administration, and thus would know the next dose should be taken when the prescribed time interval between doses has elapsed.

In alternative method of use, each time medication within bottle 12 is administered, the patient sets pointer(s) 6 to indicate the time the next dose is should be taken (by adding the prescribed time interval between doses to the present time), and thus each calendaring cap for a pharmaceutical container 2 would indicate when the next dose is due.

While a preferred embodiment of the invention has been illustrated herein, it is to be understood that changes and variations may be made by those skilled in the art without departing from the spirit of the appending claims.

Drawing Item Index

2 calendaring cap
3 cap outer surface
4 ring
5 arrow
6 pointer
7 arrow

8 day indicia
9 cap
10 hour indicia
11 arrow
12 bottle
14 cap groove
16 cap bore
18 cap female thread
20 cap bore lip
21 ring bore
22 ring bore groove
24 cap ridge

I claim:

1. A calendering cap for a pharmaceutical container, said cap comprising a cylindrical sidewall, a top end, and an open bottom, said cap having at least one ring rotationally and frictionally engaging said cylindrical sidewall, each said at least one ring comprising a ring bore sized to frictionally admit said cylindrical sidewall, at least one annular ridge on the cylindrical sidewall outer surface, said at least one ring disposed over said at least one ridge, indicia on said cylindrical sidewall and a pointer on each ring present, said cylindrical sidewall having an upper cylindrical portion and a lower cylindrical portion separated by said at least one annular ridge, said upper cylindrical portion and said lower cylindrical portion having a same diameter, said at least one annular ring spaced from said open bottom.

2. The calendering cap for a pharmaceutical container of claim 1, wherein said at least one ring includes a ring bore groove in said ring bore sized to frictionally admit one said ridge, whereby said at least one ring is constrained from translating axially relative to said cylindrical sidewall, and is thus prevented from falling off said cap.

3. The calendaring cap for a pharmaceutical container of claim 1 further comprising a cap bore in said cap, and a cap female thread in said cap bore, whereby said calendaring cap for a pharmaceutical container may be used as a closure for a standard pharmaceutical container.

4. The calendaring cap for a pharmaceutical container of claim 1 further comprising a cap bore lip on a cap bore, whereby said calendaring cap for a pharmaceutical container may be used as a "snap-on" closure for a standard pharmaceutical container.

5. A calendering cap for a pharmaceutical container, said cap comprising a cylindrical sidewall, a top end, and an open bottom, said cap having a first ring and a second ring rotationally and frictionally engaged with said cylindrical sidewall, each said ring comprising a ring bore sized to frictionally admit said cylindrical sidewall, and two sidewall ridges on said cylindrical sidewall outer surface, each said ring being disposed over one said sidewall ridge, said first ring being associated with and disposed adjacent to day indicia on said cylindrical sidewall, a pointer on said first ring pointing toward said day indicia, said second ring being associated with and disposed adjacent to hour indicia, a pointer on said second ring pointing toward said indicia, said first ring and said second ring being spaced from said open bottom.

6. The calendering cap for a pharmaceutical container of claim 5 wherein each said ring bore comprises a ring bore groove sized to frictionally admit one said ridge, whereby each said at least one ring is constrained from translating axially relative to said cylindrical sidewall, and is thus prevented from falling off said cap.

7. The calendering cap for a pharmaceutical container of claim 5 further comprising a cap bore in said cap, and a female thread in said cap bore, whereby said calendering cap for a pharmaceutical container may be used as a closure for a standard pharmaceutical container.

8. The calendering cap for a pharmaceutical container of claim 5 further comprising a cap bore lip on a cap bore, whereby said calendering cap for a pharmaceutical container may be used as a "snap-on" closure for a standard pharmaceutical container.

* * * * *